US009586311B2

(12) United States Patent
Choy

(10) Patent No.: US 9,586,311 B2
(45) Date of Patent: Mar. 7, 2017

(54) FASTENING TOOL ASSEMBLY

(71) Applicant: Arrow Fastener Co., LLC, Saddle Brook, NJ (US)

(72) Inventor: Wai Ho Choy, Flushing, NY (US)

(73) Assignee: Arrow Fastener Co., LLC, Saddle Brook, NJ (US)

( * ) Notice: Subject to any disclaimer, the term of this patent is extended or adjusted under 35 U.S.C. 154(b) by 751 days.

(21) Appl. No.: 13/866,561

(22) Filed: Apr. 19, 2013

(65) Prior Publication Data

US 2013/0292446 A1 Nov. 7, 2013

Related U.S. Application Data

(60) Provisional application No. 61/640,966, filed on May 1, 2012.

(51) Int. Cl.

| | |
|---|---|
| ***B25C 5/02*** | (2006.01) |
| ***B25C 5/06*** | (2006.01) |
| ***B25C 5/16*** | (2006.01) |

(52) U.S. Cl.

CPC ..... *B25C 5/162* (2013.01); *B25C 5/06* (2013.01); *B25C 5/1696* (2013.01)

(58) Field of Classification Search

CPC ..... B25C 5/1696; B25C 5/162; B25C 5/06; A61B 17/07207; A61B 17/068; A61B 17/00473; A61B 17/2931

(Continued)

(56) References Cited

U.S. PATENT DOCUMENTS 279,296 A * 6/1883 Whitman ..... A47F 3/00 312/123
2,311,412 A * 2/1943 Pankonin ..... B25C 5/1617 227/126

(Continued)

FOREIGN PATENT DOCUMENTS

DE 20200539 U1 5/2002
DE 202009007811 U1 10/2009

OTHER PUBLICATIONS

"Fastening Tool Assembly", U.S. Appl. No. 13/779,998, filed Feb. 28, 2013.

(Continued)

*Primary Examiner* — Robert Long
(74) *Attorney, Agent, or Firm* — Brooks Kushman P.C.; Lora Graentzdoerffer

(57) ABSTRACT

A fastening tool assembly is provided with a housing with a contact surface, a longitudinal magazine receptacle, and a fastener outlet provided through the contact surface. A magazine body is received within the magazine receptacle to translate to a retracted position whereby a proximal end is adjacent the fastener outlet to store fasteners within the receptacle and to convey the fasteners to the fastener outlet, and to translate to an extended position whereby the body extends at least partially out of the receptacle for receipt of fasteners to the receptacle. A blocker is mounted to a side of the magazine body spaced apart from the fastener intake side. The blocker has a transverse width greater than a width of the body for blocking intake of fasteners to a wrong side of the body. Instructional indicia are provided on the blocker to instruct a user regarding proper fastener installation.

20 Claims, 1 Drawing Sheet

(58) Field of Classification Search
USPC .. 227/109, 120, 156, 132, 314, 175.1–182.1
See application file for complete search history.

(56) References Cited

U.S. PATENT DOCUMENTS

| | | | | | |
|---|---|---|---|---|---|
| 3,656,678 | A * | 4/1972 | Ruskin | B25C 5/1696 | 227/128 |
| 4,113,164 | A * | 9/1978 | Muthenthaller | B25C 5/0292 | 227/124 |
| 4,312,363 | A * | 1/1982 | Rothfuss | A61B 5/1075 | 600/587 |
| 4,491,261 | A * | 1/1985 | Mitsuhashi | B25C 5/0214 | 227/76 |
| 4,556,161 | A * | 12/1985 | Oide | B25C 5/025 | 227/109 |
| 4,727,610 | A * | 3/1988 | Lin | B25C 5/0214 | 227/156 |
| 4,826,066 | A * | 5/1989 | Koester | B25C 5/11 | 227/120 |
| 5,441,191 | A * | 8/1995 | Linden | B25C 5/1689 | 227/120 |
| 5,556,020 | A * | 9/1996 | Hou | B25C 5/1658 | 227/109 |
| 5,560,530 | A * | 10/1996 | Bolanos | A61B 17/07207 | 227/176.1 |
| 5,655,697 | A * | 8/1997 | Yeh | B25C 5/0214 | 227/120 |
| 5,730,350 | A * | 3/1998 | Lin | B25C 5/1658 | 227/120 |
| 5,735,444 | A * | 4/1998 | Wingert | B25C 5/00 | 227/119 |
| 5,765,742 | A * | 6/1998 | Marks | B25C 5/1696 | 227/120 |
| 6,085,959 | A * | 7/2000 | Lee | B25C 1/005 | 227/120 |
| 6,206,897 | B1 * | 3/2001 | Jamiolkowski | A61B 17/122 | 606/157 |
| 6,367,676 | B1 * | 4/2002 | Opland | B25C 5/11 | 227/123 |
| 6,672,499 | B1 * | 1/2004 | Lee | B25C 5/161 | 227/120 |
| 6,726,081 | B1 * | 4/2004 | Lin | B25C 5/0292 | 227/123 |
| 7,240,819 | B2 * | 7/2007 | Chang | B25C 5/0242 | 227/120 |
| 7,322,504 | B2 * | 1/2008 | Chen | B25C 5/0242 | 227/127 |
| 7,637,407 | B2 | 12/2009 | Shor | | |
| 7,815,089 | B2 | 10/2010 | Shor | | |
| 8,485,409 | B2 * | 7/2013 | Chen | B25C 5/11 | 227/120 |
| 2002/0108996 | A1 * | 8/2002 | Cornett | B25C 5/00 | 227/132 |
| 2003/0115738 | A1 * | 6/2003 | Barlow | B25C 5/00 | 29/592 |
| 2004/0040999 | A1 * | 3/2004 | Ackeret | B25C 5/1679 | 227/63 |
| 2005/0216036 | A1 * | 9/2005 | Nakao | A61B 17/068 | 606/142 |
| 2006/0144893 | A1 * | 7/2006 | Lee | B25C 5/02 | 227/134 |
| 2006/0219752 | A1 * | 10/2006 | Arad | A61B 17/07207 | 227/176.1 |
| 2006/0231582 | A1 * | 10/2006 | Hong | B25C 5/1651 | 227/109 |
| 2008/0149685 | A1 * | 6/2008 | Smith | A61B 17/0643 | 227/181.1 |
| 2008/0257931 | A1 * | 10/2008 | Lin | B25C 5/0214 | 227/76 |
| 2009/0134200 | A1 * | 5/2009 | Tarinelli | A61B 17/07207 | 227/180.1 |
| 2009/0152318 | A1 * | 6/2009 | Matsukawa | B25C 5/0207 | 227/129 |
| 2009/0206131 | A1 * | 8/2009 | Weisenburgh, II | A61B 17/07207 | 227/175.2 |
| 2009/0206135 | A1 * | 8/2009 | Hall | A61B 17/07207 | 227/176.1 |
| 2010/0089964 | A1 * | 4/2010 | Chen | B25C 5/1658 | 227/120 |
| 2010/0193570 | A1 * | 8/2010 | Ehrenfels | A61B 17/07207 | 227/176.1 |
| 2011/0036891 | A1 * | 2/2011 | Zemlok | A61B 17/07207 | 227/176.1 |
| 2011/0139852 | A1 * | 6/2011 | Zingman | A61B 17/072 | 227/176.1 |
| 2012/0031636 | A1 * | 2/2012 | King | B25B 23/00 | 173/20 |
| 2012/0234894 | A1 * | 9/2012 | Kostrzewski | A61B 17/07207 | 227/175.2 |
| 2012/0234895 | A1 * | 9/2012 | O'Connor | A61B 17/07207 | 227/176.1 |
| 2013/0037596 | A1 * | 2/2013 | Bear | A61B 17/07207 | 227/176.1 |

OTHER PUBLICATIONS

European Search Report for corresponding Application No. 13166149.8-1701, mailed Sep. 9, 2015, 6 pages.

* cited by examiner

FASTENING TOOL ASSEMBLY

CROSS-REFERENCE TO RELATED APPLICATIONS

This application claims the benefit of U.S. provisional Application No. 61/640,966 filed May 1, 2012, the disclosure of which is incorporated in its entirety by reference herein.

TECHNICAL FIELD

Various embodiments relate to fastening tool assemblies.

BACKGROUND

The prior art has provided various fastening tool assemblies with various magazine bodies for loading fasteners into the fastening tool assembly. The various varieties may cause consumer confusion regarding how to properly install fasteners into a particular fastening tool assembly. Improper installation may cause binding or other potential problems or difficulties regarding the fastening tool assembly.

SUMMARY

According to at least one embodiment, a fastening tool assembly is provided with a housing provided with a contact surface to contact a workpiece, a magazine receptacle oriented longitudinally within the housing, a fastener intake opening formed through the contact surface to the receptacle, and a fastener outlet provided through the contact surface to dispense fasteners from the outlet. A magazine body has a proximal end and a distal end spaced apart from the proximal end. The magazine body is received within the magazine receptacle to translate longitudinally to a retracted position whereby the proximal end is adjacent the fastener outlet to store fasteners within the receptacle and to convey the fasteners to the fastener outlet, and to translate to an extended position whereby the body extends at least partially out of the receptacle and external of the housing for receipt of fasteners to the receptacle through the intake opening. Instructional indicia are provided on a side of the magazine body that is not a fastener intake side to instruct the user regarding proper fastener installation.

According to at least another embodiment, a fastening tool assembly is provided with a housing provided with a contact surface to contact a workpiece, a magazine receptacle oriented longitudinally within the housing, and a fastener outlet provided through the contact surface to dispense fasteners from the outlet. A magazine body has a proximal end and a distal end spaced apart from the proximal end. The magazine body is received within the magazine receptacle to translate longitudinally to a retracted position whereby the proximal end is adjacent the fastener outlet to store fasteners within the receptacle and to convey the fasteners to the fastener outlet, and to translate to an extended position whereby the body extends at least partially out of the receptacle and external of the housing for receipt of fasteners to the receptacle. The magazine body includes a fastener intake side wherein fasteners are inserted into at least one of the receptacle and the body. A blocker is mounted to a side of the magazine body spaced apart from the fastener intake side. The blocker has a transverse width greater than a width of the body for blocking intake of fasteners to a wrong side of the body.

According to at least another embodiment, a fastening tool assembly is provided with a housing that is provided with a contact surface to contact a workpiece, a magazine receptacle oriented longitudinally within the housing, and a fastener outlet provided through the contact surface to dispense fasteners from the outlet. A magazine body has a proximal end and a distal end spaced apart from the proximal end. The magazine body is received within the magazine receptacle to translate longitudinally to a retracted position whereby the proximal end is adjacent the fastener outlet to store fasteners within the receptacle and to convey the fasteners to the fastener outlet, and to translate to an extended position whereby the body extends at least partially out of the receptacle and external of the housing for receipt of fasteners to the receptacle. The magazine body includes a fastener intake side wherein fasteners are inserted into at least one of the receptacle and the body. A blocker is mounted to a side of the magazine body spaced apart from a fastener intake side. The blocker has a transverse width greater than a width of the body for blocking intake of fasteners to a wrong side of the body. Instructional indicia are provided on the blocker to instruct a user regarding proper fastener installation.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
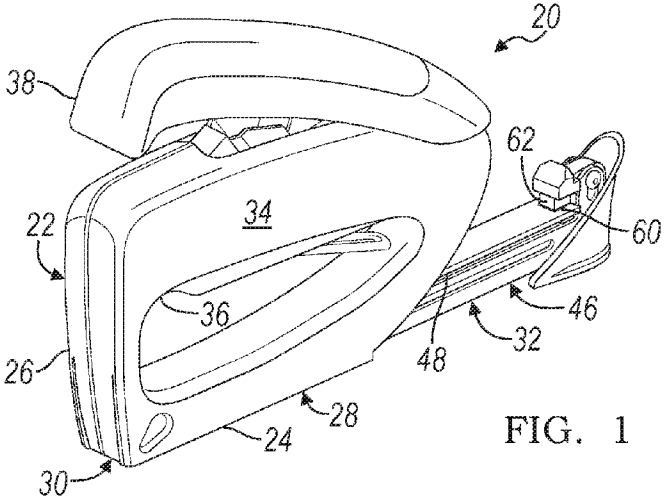
FIG. 1 is a perspective view of a fastening tool assembly according to an embodiment, illustrated with a magazine body extending therefrom.
Figure 2:
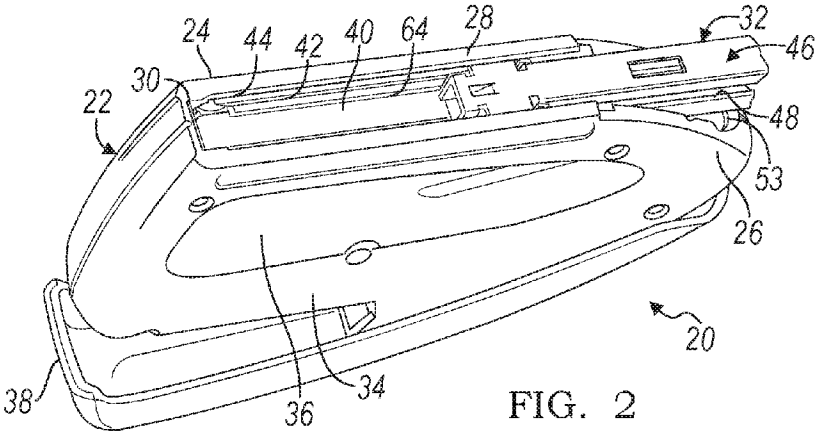
FIG. 2 is a bottom perspective view of the fastening tool assembly of FIG. 1.

Referring to FIGS. 1 and 2, a fastening tool assembly, such as a manual staple gun is illustrated and referenced by numeral 20. Although the fastening tool assembly 20 is illustrated and described as a staple gun, the invention contemplates any fastening tool that drives a fastener into a workpiece.

The staple gun 20 has a housing 22, which may be formed from a pair of housing portions 24, 26. The housing 22 has a workpiece contact surface 28 for engaging a workpiece. A fastener outlet 30 is provided through the contact surface 28 for egress of fasteners from the staple gun 20. A magazine assembly 32 is also provided in the housing 22 for storing fasteners, and conveying the fasteners to the outlet 30.

The housing 22 also provides a grip 34 spaced apart from the magazine assembly 32 with an opening, or finger well 36, between the grip 34 and the magazine assembly 32, for receipt of a user's fingers when grasping the grip 34. A handle 38 is pivotally connected to the housing 22 for manual actuation for driving a fastener from the outlet 30. In operation, a user inserts her or his fingers into the finger well 36 for contact with the grip 34. The user wraps her or his thumb about the handle 38 so that the user's palm engages the handle 38. By squeezing the grip 34 and handle 38, or by pressing the handle 38 toward the housing 22, the user actuates the staple gun 20 thereby driving a staple out of the staple outlet 30.

The magazine assembly 32 receives a strip of fasteners that are typically adhered collectively in a linear array by an adhesive. The magazine assembly 32 includes a magazine receptacle 40 that is oriented longitudinally to the housing 22. The receptacle 40 may formed integrally with the housing 22, or may be formed from a separate component or material, such as stamped steel, and may be assembled into the housing 22. In the depicted embodiment, the receptacle 40 provides a cavity 42 within the housing 22. The cavity 42 is accessible through an intake opening 44 formed through the contact surface 28 of the housing 22.

Figure 3:
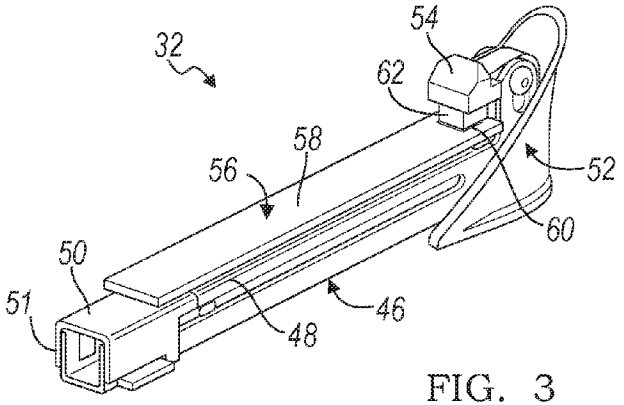
FIG. 3 is a perspective view of the magazine body of FIG. 1.

Referring now to FIGS. 1-3, a magazine body 46 is received within the receptacle 40 to translate longitudinally for extension from the housing 22 for reloading of fasteners to the magazine assembly 32. The body 46 provides a guide 48 for receiving the fasteners. A spring-loaded pusher 50 is provided upon the guide 48. The pusher 50 has a forward end 51 that is sized corresponding to a fastener for a surface contact against a trailing fastener of the fastener strip. Insertion of the body 46 into the receptacle 40 causes the pusher 50 to retract along the guide 48 as the guide 48 receives fasteners. The fasteners engage the pusher 50, thereby loading the pusher spring. The spring-loaded pusher 50 presses the fasteners toward the fastener outlet 30 so that as each fastener egresses the outlet 30, the next sequential fastener is translated into position with the fastener outlet 30. In the retracted position of the magazine body 46, the body 46 also encloses the receptacle 40 and may form part of the contact surface 28.

A latch mechanism 52 is provided on the magazine body 46. The latch mechanism 52 is mounted to the magazine body 46 to pivot and translate relative to the body 46. The latch mechanism 52 is spring-loaded to maintain engagement of the latch mechanism 52 with a corresponding notch 53 (FIG. 2) on the housing 22. The user presses the magazine body 46 into the receptacle 40 whereby a leading edge 54 of the latch mechanism 52 engages the housing 22, translating the latch mechanism 52 toward the magazine body 46. As the latch mechanism 52 aligns with the notch 53, the latch mechanism 52 is extended into the notch 53, thereby latching the magazine body 46 into the receptacle 40. In order to retract the magazine body 46, the user pulls the latch magazine 52 down until it disengages from the notch 53.

Figure 4:
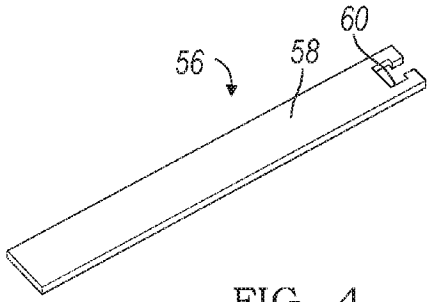
FIG. 4 is a perspective view of a blocker of the magazine body of FIG. 3.

In the extended position of the magazine body 46, a user may inadvertently attempt to install a fastener strip upon the guide 48 of the magazine body 46. Accordingly, a blocker 56 is provided upon the magazine body 46 on a side of the magazine body 46 that is spaced apart from the intake opening 44. The blocker 56 is illustrated disassembled from the magazine body 46 in FIG. 4. The blocker 56 may formed as a plate with a transverse width that is greater than a width of the fasteners to act as a staple stopper and prevent inadvertent installation of the fasteners upon the magazine body 46. Moreover, the blocker 56 has a transverse width greater than a width of the magazine body 46 to prevent inadvertent loading of the fasteners upon the magazine body 46.

Instructional indicia 58 can be provided upon the blocker 56 to instruct the user not to insert fasteners directly upon the guide 48. The instructional indicia may also instruct the user to insert fasteners into the intake opening 44 thereby instructing the user on proper installation of fasteners. The instructional indicia 58 could be provided upon any surface of the magazine body 46 for informing the user at any exposed surface.

The blocker 56 includes a keyed notch 60 for assembling the blocker 56 to the latch mechanism 52. The latch mechanism 52 includes an upright key 62 extending through the notch 60 in the blocker 56 for retaining the blocker 56. The blocker 56 extends over the pusher 50 and the guide 48; and the blocker 56 provides clearance for translation of the pusher 50 and fasteners upon the guide 48. A slot 64 is provided within the receptacle 40 for receiving the blocker 56 and maintaining the blocker 56 spaced apart from the guide 48, the pusher 50 and the fasteners.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fastening tool assembly comprising:

a housing comprising a contact surface to contact a workpiece, a magazine receptacle oriented longitudinally within the housing, a fastener intake opening formed through the contact surface to the receptacle, and a fastener outlet provided through the contact surface to dispense fasteners from the outlet;

a magazine body having a proximal end and a distal end spaced apart from the proximal end, the magazine body being received within the magazine receptacle to translate longitudinally to a retracted position whereby the proximal end is adjacent the fastener outlet to store fasteners within the receptacle and to convey the fasteners to the fastener outlet, and to translate to an extended position whereby the body extends at least partially out of the receptacle and external of the housing for receipt of fasteners to the receptacle through the intake opening;

instructional indicia provided on a side of the magazine body that is not a fastener intake side to instruct a user regarding proper fastener installation; and a blocker fixed to a side of the magazine body during the extended position and the retracted position thereof, the blocker being spaced apart from the fastener intake side to block intake of fasteners to a wrong side of the body.

2. The fastening tool assembly of claim 1 wherein the blocker has a transverse width greater than a width of the body.

3. The fastening tool assembly of claim 1 wherein a slot is provided within the receptacle to receive the blocker and maintain the blocker spaced apart from the magazine body and the fasteners.

4. The fastening tool assembly of claim 1 further comprising a latch mechanism mounted to the magazine body to engage the housing and to latch the magazine body to the housing.

5. The fastening tool assembly of claim 4 wherein the latch mechanism further comprises an upright key; and wherein the blocker includes a keyed notch sized to receive the upright key to retain the blocker.

6. The fastening tool assembly of claim 1 wherein the receptacle includes a cavity formed with the housing.

7. The fastening tool assembly of claim 6 wherein the cavity is accessible through the fastener intake opening.

8. The fastening tool assembly of claim 1 wherein the magazine body encloses the receptacle in the retracted position.

9. The fastening tool assembly of claim 8 wherein the magazine body forms part of the contact surface in the retracted position.

10. A fastening tool assembly comprising:

a housing comprising a contact surface to contact a workpiece, a magazine receptacle oriented longitudinally within the housing, and a fastener outlet provided through the contact surface to dispense fasteners from the outlet;

a magazine body having a proximal end and a distal end spaced apart from the proximal end, the magazine body being received within the magazine receptacle to translate longitudinally to a retracted position whereby the proximal end is adjacent the fastener outlet to store fasteners within the receptacle and to convey the fasteners to the fastener outlet, and to translate to an extended position whereby the body extends at least partially out of the receptacle and external of the housing for receipt of fasteners to the receptacle, the magazine body comprising a fastener intake side wherein fasteners are inserted into at least one of the receptacle and the body; and a blocker fixed to a side of the magazine body during the extended position and the retracted position thereof, the blocker being spaced apart from a fastener intake side, the blocker having a transverse width greater than a width of the body to block intake of fasteners to a wrong side of the body.

11. The fastening tool assembly of claim 10 wherein the blocker has a transverse width greater than a width of the body.

12. The fastening tool assembly of claim 10 wherein a slot is provided within the receptacle to receive the blocker and to maintain the blocker spaced apart from the magazine body and the fasteners.

13. The fastening tool assembly of claim 10 further comprising a latch mechanism mounted to the magazine body to engage the housing and to latch the magazine body to the housing.

14. The fastening tool assembly of claim 13 wherein the latch mechanism further comprises an upright key; and wherein the blocker includes a keyed notch sized to receive the upright key to retain the blocker.

15. The fastening tool assembly of claim 10 wherein the magazine body provides a guide to receive the fasteners.

16. The fastening tool assembly of claim 15 further comprising a spring-loaded pusher provided on the guide with a forward end corresponding to a fastener for a surface contact against a trailing fastener of a fastener strip.

17. The fastening tool assembly of claim 16 wherein the blocker extends over the pusher and the guide; and wherein the blocker provides clearance for translation of the pusher and fasteners upon the guide.

18. The fastening tool assembly of claim 17 wherein a slot is provided within the receptacle to receive the blocker and to maintain the blocker spaced apart from the guide, the pusher and the fasteners.

19. The fastening tool assembly of claim 1, wherein the blocker is mounted to the magazine body and spaced from the fastener intake side when the magazine body is in the extended position.

20. The fastening tool assembly of claim 10, wherein the blocker is mounted to the magazine body and spaced from the fastener intake side when the magazine body is in the extended position.

* * * * *